US006521888B1

(12) United States Patent
Carlson

(10) Patent No.: US 6,521,888 B1
(45) Date of Patent: Feb. 18, 2003

(54) INVERTED ORBIT FILTER

(75) Inventor: Arthur Carlson, Garching (DE)

(73) Assignee: Archimedes Technology Group, Inc., San Diego, CA (US)

( * ) Notice: Subject to any disclaimer, the term of this patent is extended or adjusted under 35 U.S.C. 154(b) by 0 days.

(21) Appl. No.: 09/489,191

(22) Filed: Jan. 20, 2000

(51) Int. Cl.[7] ..... B03C 1/30
(52) U.S. Cl. ..... 250/291
(58) Field of Search ..... 250/291, 281, 250/283, 298; 209/39

(56) References Cited

U.S. PATENT DOCUMENTS

| | | | | |
|---|---|---|---|---|
| 5,350,454 | A | 9/1994 | Ohkawa | |
| 5,868,909 | A | 2/1999 | Eastlund | |
| 6,217,776 | B1 * | 4/2001 | Ohkawa | 210/695 |
| 6,248,240 | B1 * | 6/2001 | Ohkawa | 210/695 |
| 6,251,281 | B1 * | 6/2001 | Ohkawa | 210/695 |
| 6,251,282 | B1 * | 7/2001 | Putvinski et al. | 210/695 |
| 6,294,781 | B1 * | 9/2001 | Ohkawa | 250/297 |
| 6,322,706 | B1 * | 11/2001 | Ohkawa | 210/695 |

OTHER PUBLICATIONS

Bittencourt et al., Steady State Behavior of Rotating Plasmas in a Vacuum–Arc Centrifuge, pp 601–620, Plasma Physics and Controlled Fusion, vol. 29, No. 5, 1987.

Kim et al., Equilibria of a Rigidly Rotating, Fully Ionized Plasma Column, pp 4689–4690, J. Appl. Phys. 61 (9), May 1, 1987.

Simpson et al., Acceleration Mechanism in Vacuum Arc Centrifuges, pp 1040–1046, J. Phys. D: Appl. Phys 29, 1996.

* cited by examiner

*Primary Examiner*—John R. Lee
*Assistant Examiner*—Anthony Quash
(74) *Attorney, Agent, or Firm*—Nydegger & Associates

(57) ABSTRACT

An inverted orbit mass filter includes a cylindrical container located at a radial distance ($r_{out}$) from its longitudinal axis, and a cylindrical collector located at a radial distance ($r_{coll}$) from the axis and coaxially positioned in the container to establish a plasma chamber therebetween. A uniform magnetic field is axially aligned in the chamber and an inwardly directed radial electric field is crossed with the magnetic field. A multi-species plasma including both low mass charged particles ($M_1$) and high mass charged particles ($M_2$) is injected into the chamber between the container ($r_{out}$) and a radial distance ($r_{in}$) from the axis. In their relationship to each other: $r_{out}>r_{in}>r_{coll}$. Inside the chamber the multi-species plasma has a low collisional density wherein there is a very low probability of particle collision. Consequently, with respective cyclotron trajectories $T_1$ and $T_2$ for the particles $M_1$ and $M_2$, when $T_1<(r_{in}-r_{coll})$ and $T_2>(r_{out}-r_{in})$ then the particles $M_2$ will be influenced by the magnetic and electric fields into collision with the collector, and the particles $M_1$ will avoid the collector and, therefore, pass through the chamber for subsequent collection.

20 Claims, 2 Drawing Sheets

INVERTED ORBIT FILTER

FIELD OF THE INVENTION

The present invention pertains generally to devices and methods for separating particles according to their mass. More particularly, the present invention pertains to devices and methods which rely on the orbital mechanics of charged particles, under the influence of a magnetic field in a low collisional density environment, to separate the particles from each other. The present invention is particularly, but not exclusively, useful for separating ions having a low mass to charge ratio from ions having a high mass to charge ratio in a multi-species plasma.

BACKGROUND OF THE INVENTION

There are many reasons why it may be desirable to separate or segregate mixed materials from each other. Indeed, many different types of devices, which rely on different physical phenomena, have been proposed for this purpose. For example, settling tanks which rely on gravitational forces to remove suspended particles from a solution and thereby segregate the particles are well known and are commonly used in many applications. As another example, centrifuges which rely on centrifugal forces to separate substances of different densities are also well known and widely used. In addition to these more commonly known methods and devices for separating materials from each other, there are also devices which are specifically designed to handle special materials. A plasma centrifuge is an example of such a device.

As is well known, a plasma centrifuge is a device which generates centrifugal forces that separate charged particles in a plasma from each other. For its operation, a plasma centrifuge necessarily establishes a rotational motion for the plasma about a central axis. A plasma centrifuge also relies on the fact that charged particles (ions) in the plasma will collide with each other during this rotation. The result of these collisions is that the relatively high mass ions in the plasma will tend to collect at the periphery of the centrifuge. On the other hand, these collisions will generally exclude the lower mass ions from the peripheral area of the centrifuge. The consequent separation of high mass ions from the relatively lower mass ions during the operation of a plasma centrifuge, however, may not be as complete as is operationally desired, or required.

Apart from a centrifuge operation, it is well known that the orbital motions of charged particles (ions) which have the same velocity in a magnetic field, or in crossed electric and magnetic fields, will differ from each other according to their respective masses. Thus, when the probability of ion collision is significantly reduced, the possibility for improved separation of the particles due to their orbital mechanics is increased. For example, U.S. application Ser. No. 09/192,945 which was filed on Nov. 16, 1998, by Ohkawa for an invention entitled "Plasma Mass Filter" and which is assigned to the same assignee as the present invention discloses a device which relies on the different orbital motions of charged particles in a low density environment to separate the charged particles from each other. As implied above, In order to do this the plasma must be generated under low density conditions where the collisionality of the plasma is low. For purposes of the present invention, the collisionality of the plasma is considered to be low when the ratio of ion cyclotron frequency to ion collisional frequency is approximately equal to one, or is greater than one.

As indicated above, plasma centrifuges require a rotational motion of the plasma in order to generate centrifugal forces that are required for separating particles in the plasma from each other. To generate such a motion, centrifuges have typically used an inwardly directed axisymmetric radially oriented electric field. Heretofore, however, the plasma densities have been maintained relatively high in order to achieve a maximum throughput. With very low densities, however, and particularly densities that have very low collisionality, the orbital mechanics of charged particles can be advantageously used to separate the particles from each other according to their respective masses. Consequently, as more thoroughly indicated in the mathematics set forth below, when the collisionality of a plasma is low, charged particles in the plasma, which have different masses, can be distinguished by their respective orbits. Furthermore, when an axisymmetric electric field is employed in a low collision density environment, an inwardly directed electric field can assist in the process of separation. However, in contrast to both the plasma centrifuge and the plasma mass filter, the heavy particles are preferentially located at small radius.

Consider now the parameters that are involved for a cylindrical plasma mass filter when the ionization region extends from $r_{in}$ to $r_{out}$. Also consider that none of the orbits of the light ions may extend farther in than the collector radius $r_{coll}$, not even those with the highest mass to charge ($M_1$) that start at the smallest radius ($r_{in}$). All of the orbits of the heavy ions must extend in at least as far as the collector radius $r_{coll}$, even those with the lowest mass to charge ($M_2$) that start at the largest radius ($r_{out}$).

It can be shown that the turning points $r_{0,1}$ for an arbitrary potential $\phi(r)$ are given by $$\frac{8mr_{0,1}^2}{q^2B^2}(W - q\phi(r_{0,1})) - \left(r_{0,1}^2 - \frac{2L}{qB}\right)^2 = 0,$$

where W is the total energy (kinetic plus potential) and L is the canonical angular momentum (mechanical plus magnetic), both constants of the motion. If the particle is at rest at $r_0$ (because the ionization occurs there), then the energy is $W=q\phi(r_0)$ and the canonical angular momentum is $L=qBr_0^2/2$, so that $$\frac{8mr_1^2}{qB^2}(\phi(r_0) - \phi(r_1)) - (r_1^2 - r_0^2)^2 = 0,$$

or $$\frac{8m\Delta\phi_{0-1}}{qB^2r_0^2} = \left(\frac{r_1}{r_0} - \frac{r_0}{r_1}\right)^2,$$

where we have defined the potential drop $\Delta\phi_{0-1}=\phi(r_0)-\phi(r_1)$, which is always positive.

In an inverted filter, the ions with mass $m_h$ born at $r_{out}$ turn around again at $r_{coll}$, so we have $$\frac{8m_h\Delta\phi_{out\text{-}coll}}{qB^2r_{out}^2} = \left(\frac{r_{out}}{r_{coll}} - \frac{r_{coll}}{r_{out}}\right)^2.$$

If the potential drop and machine size are fixed by practical considerations, the magnetic field can be made large if $r_{coll} \approx r_{out}$. A large field improves throughput by allowing a larger density before collisionality degrades performance, but this would be offset by the decreased area available between $r_{coll}$ and $r_{out}$. A practical compromise and the preferred embodiment, subject to optimization in a detailed design, is to use half the area for plasma, implying $r_{coll}=r_{out}/\sqrt{2}$ and $$\frac{8m_h\Delta\phi_{out\text{-}coll}}{qB^2r_{out}^2}=\frac{1}{2}.$$

Another important question is the allowed radial extent of the source. A separator will not be practical if the ionization must be confined to too narrow a region. Applying the formula derived above to ions with mass $m_l$ born at $r_{in}$, which must also turn around again at $r_{coll}$, we have $$\frac{8m_l\Delta\phi_{\text{in-}coll}}{qB^2r_{\text{in}}^2}=\left(\frac{r_{\text{in}}}{r_{coll}}-\frac{r_{coll}}{r_{\text{in}}}\right)^2,$$

or $$\frac{m_l\Delta\phi_{\text{in-}coll}}{m_h\Delta\phi_{out\text{-}coll}}=\frac{\left(\left(\frac{r_{\text{in}}}{r_{coll}}\right)^2-1\right)^2}{\left(\left(\frac{r_{out}}{r_{coll}}\right)^2-1\right)^2}.$$

Given the form of the potential, the masses, and $(r_{out}/r_{coll})$, this equation determines how much room can be allowed for ionization $(r_{out}-r_{in})$.

The normal axisymmetric plasma mass filter has $\phi(r)$ proportional to $r^2$ . If we insert this potential profile into the equation above, we find $$\frac{\left(m_l\left(\left(\frac{r_{\text{in}}}{r_{coll}}\right)^2-1\right)\right)}{m_h\left(\left(\frac{r_{out}}{r_{coll}}\right)^2-1\right)}=\frac{\left(\left(\frac{r_{\text{in}}}{r_{coll}}\right)^2-1\right)^2}{\left(\left(\frac{r_{out}}{r_{coll}}\right)^2-1\right)^2},$$

or $$\left(\frac{r_{\text{in}}}{r_{coll}}\right)^2=\frac{m_l}{m_h}\left(\left(\frac{r_{out}}{r_{coll}}\right)^2-1\right)+1.$$

In light of the above, it is an object of the present invention to provide a plasma mass filter which has an inwardly directed electric field. It is another object of the present invention to provide a plasma mass filter which employs an axisymmetric electric field to influence the movements of high mass charged particles toward a centrally located collector. Still another object of the present invention is to provide a plasma mass filter which will differentiate between the masses of the charged particles in the plasma independently of the initial positions and velocities of the particles. Yet another object of the present invention is to provide for a plasma mass filter which is simple effective to use, relatively easy to manufacture, and comparatively cost effective.

SUMMARY OF THE PREFERRED EMBODIMENTS

In accordance with the present invention, an inverted orbit plasma mass filter includes a cylindrical container that defines a longitudinal axis. The container surrounds a cylindrical collector that is oriented coaxially with the container. Together these components establish an annular shaped plasma chamber that is located between the container and the collector.

A plurality of magnetic coils are mounted on the outside of the container to surround the chamber and generate a substantially uniform magnetic field (B) in the chamber that is generally parallel to the longitudinal axis of the filter. Additionally, an electrode is mounted at one end of the cylindrical container to generate a radially oriented electric field (E) in the chamber. Importantly, the electric field is directed inwardly from the container toward the collector. As intended for the present invention, the electrode may either be a plurality of coaxially oriented rings or a spiral electrode. Further, an electrode can be mounted at both ends of the container, if desired.

A source for injecting a multi-species plasma into said chamber is provided which, for purposes of disclosure will include both charged particles of a relatively low mass ($M_1$) and of a relatively high mass ($M_2$). More technically, they are particles ($M_1$) of relatively low mass to charge ratio and particles ($M_2$) of relatively high mass to charge ratio. As indicated above, however, these terms will be used interchangeably herein. Specifically, the low mass particles ($M_1$) will have a cyclotron frequency and will orbit in the magnetic field (B) and the electric field (E) with a cyclotron trajectory $T_1$ which will depend on the initial radial position and velocity of the particles. Likewise, the particles of relatively high mass ($M_2$) will have a cyclotron frequency, and a cyclotron trajectory $T_2$ in the magnetic field (B) and electric field (E) which will also depend on the initial radial position and velocity of the particles. For the same initial radial position and velocity, $T_2$ will be greater than $T_1$ ($T_2>T_1$).

It is an important aspect of the present invention that the multi-species plasma operates with a density less than the "collisional density." For purposes of the present invention, the "collisional density" is realized under conditions wherein a ratio between the cyclotron frequency of the charged particles and the collisional frequency of the particles in the chamber (i.e. ion-ion and ion-neutral collisions) is greater than approximately one.

Structurally, and operationally, several design dimensions for the filter of the present invention are of interest. Specifically, if the collector is located at a radial distance $r_{coll}$ from the longitudinal axis, the multi-species plasma should be injected into the chamber between the radial distances $r_{in}$ and $r_{out}$For the present invention the distances $r_{in}$ and $r_{out}$ are measured from the longitudinal axis and their relationship to each other and to $r_{coll}$ is: $r_{coll}$ is less than $r_{in}$, and $r_{in}$ is less than $r_{out}$, ($r_{coll}<r_{in}<r_{out}$).

Within the dimensional configuration defined above, consider the cyclotron trajectory of a relatively high mass particle $M_2$ as it moves under the influence of the electric field (E) and magnetic field (B) from an initial radial position of $r_{out}$. When the cyclotron trajectory $T_2$, of the relatively higher mass particle $M_2$ is greater than $(r_{out}-r_{coll})$, then substantially all of the high mass particles ($M_2$) will move into contact with the collector, regardless of their respective initial positions between $r_{in}$ and $r_{out}$. On the other hand, consider the cyclotron trajectory of a relatively low mass particle $M_1$ from an initial radial position of $r_{in}$. When the cyclotron trajectory $T_1$, of the relatively lower mass particles $M_1$ is less than the difference $(r_{in}-r_{coll})$, then substantially none of the low mass particles ($M_1$) will orbit into contact with the collector regardless of their initial position between $r_{in}$ and $r_{out}$. These considerations, coupled with conditions that are desirable for high throughput, lead to a design for the filter of the present wherein it can be mathematically shown that $r_{coll}$ is approximately equal to the square root of two times smaller than $r_{out}$ ($r_{coll}\approx r_{out}/\sqrt{2}$). Furthermore, the most desirable relationship between $r_{in}$ and $r_{out}$ is determined by the ratio of the masses of the heavy and light particles $M_2/M_1$. For example, when $M_2/M_1$ =2, then $r^2_{in}$ approx= $(3/4)r^2_{out}$.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENT

Figure 1:
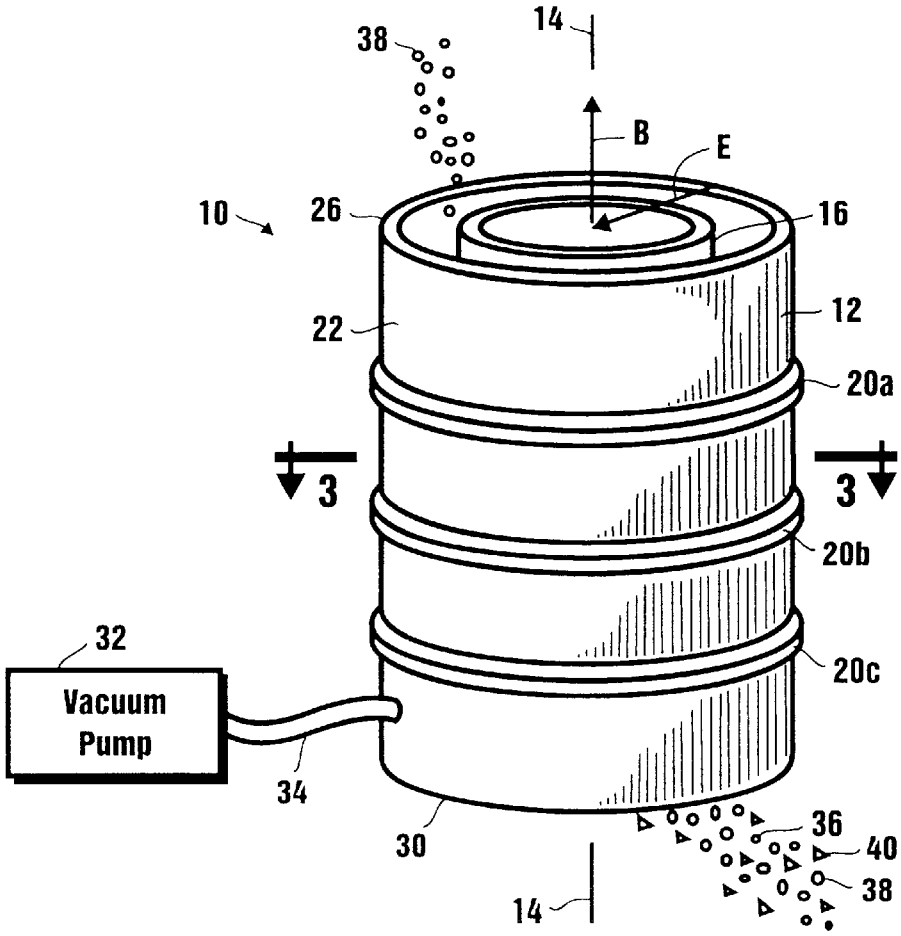
FIG. 1 is perspective view of the inverted plasma mass filter of the present invention with portions taken away for clarity.

Referring initially to FIG. 1, an inverted orbit plasma filter in accordance with the present invention is shown and is generally designated 10. FIG. 1 also shows that the filter 10 includes a substantially cylindrical shaped container 12 which defines a longitudinal axis 14. Oriented coaxially with the container 12 along the longitudinal axis 14 is a collector 16 which is distanced from the container 12 to establish a substantially annular shaped plasma chamber 18 between the container 12 and the collector 16.

FIG. 1 also shows that the filter 10 includes a plurality of magnetic coils 20 which are mounted on the outer surface 22 of the container 12. The specific magnetic coils 20*a–c* shown in FIG. 1 are only exemplary, as it will be appreciated by the skilled artisan that several magnetic systems well known in the pertinent art would be suitable for the present invention. More specifically, it is important that the magnetic coils 20*a–c* (or any other magnetic system) generate a magnetic field (B) inside the chamber 18 which is substantially uniform and which is directed substantially parallel to the longitudinal axis 14.

Figure 2A:
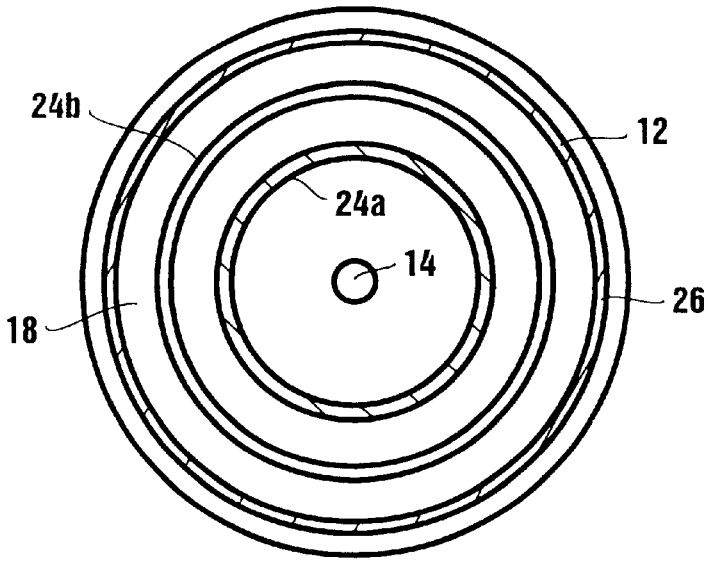
FIG. 2A is a top plan view of a plurality of electrode rings useful for generating the electric field for the present invention.
Figure 2B:
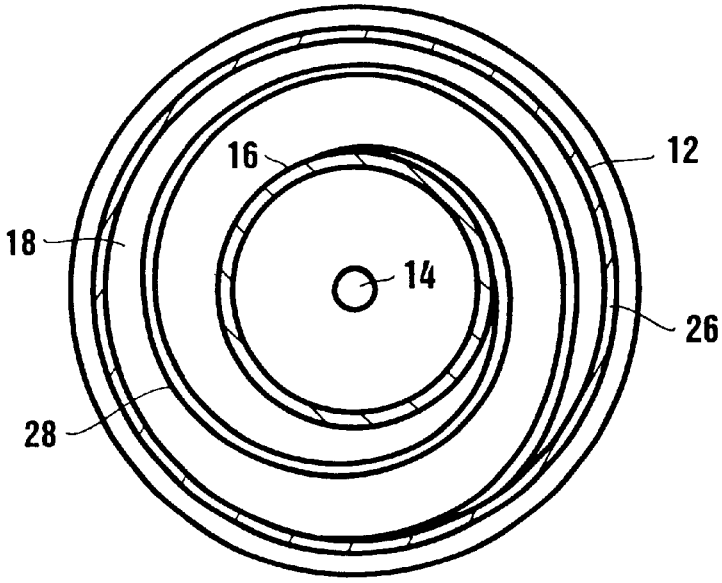
FIG. 2B is a top plan view of a spiral electrode useful for generating the electric field for the present invention.

In addition to the magnetic field (B), it is necessary for the operation of the inverted orbit plasma filter 10 that an electric field (E) also be generated inside the plasma chamber 18. For the present invention, the electric field (E) must have several specific characteristics. Importantly, the electric field (E) must be directed inwardly through the plasma chamber 18 toward the longitudinal axis 14 and it may be constant or variable. Preferably, to establish the electric field (E) in the chamber 18, the container 12 will be grounded, and there will be a negative potential established along the longitudinal axis 14. For this purpose, FIGS. 2A and 2B both illustrate different possible components which can be used for generating the electric field (E). FIG. 2A shows a plurality of concentric coplanar ring electrodes 24 (the ring electrodes 24*a* and 24*b* are only exemplary) which can be used for generating the electric field (E). In particular, these ring electrodes 24*a* and 24*b* are oriented with their respective planes substantially perpendicular to the longitudinal axis 14, and they are positioned at an end 26 of the container 12. Alternatively, FIG. 2B shows a spiral electrode 28 which can be used for this same purpose. Like the ring electrodes 24*a–b*, the spiral electrode 28 is also oriented substantially perpendicular to the longitudinal axis 14, and it is positioned at the end 26. The skilled artisan will appreciate that additional ring electrodes 24, or an additional spiral electrode 28, can also be placed at the end 30 of container 12 so that the electric field (E) will be generated by electrodes (24 or 28) at both ends 26 and 30 of container 12.

FIG. 1 further shows that the filter 10 includes a vacuum pump 32 which is connected in fluid communication with the plasma chamber 18 via a conduit 34. In accordance with the present invention, a sufficient vacuum needs to be drawn in the chamber 18 so that the plasma can be operated at a "low collisional" density. For the present invention, this "low collisional" density is determined by the multi-species plasma 36 that is to be provided inside the chamber 18, and the cyclotron reaction of the plasma 36 to the magnetic field (B) in the chamber 18. More specifically, the "low collisional" density is realized when the probability of ion-ion collisions and ion-neutral collisions in the chamber 18 is very low.

As intended for the present invention, the filter 10 will process a multi-species plasma 36 which includes different types of charged particles. For purposes of discussion, the multi-species plasma 36 will be considered as including both charged particles of relatively low mass ($M_1$) and particles of relatively high mass ($M_2$). As indicated elsewhere herein, it is perhaps more technically correct to refer to charged particles ($M_1$) having a relatively low mass to charge ratio, and charged particles ($M_2$) having a relatively high mass to charge ratio. Nevertheless, in the context of the present invention, these terms are sometimes used interchangeably.

It is known that when charged particles 38, 40 ($M_1$ or $M_2$) move at a velocity v perpendicular to a magnetic field (B), they will move on a circular path at a cyclotron frequency. Thus, for definitional purposes, the "low collisional" density mentioned above will be realized when the ratio of cyclotron frequency to collision frequency is greater than one. Stated differently, a "low collisional" density is realized in the chamber 18 when there is a very low probability that an ion (e.g. a charged particle 38, 40 ($M_1$ or $M_2$)) will collide with another ion (i.e. an ion-ion collision), or with a neutral (i.e. an ion-neutral collision), during its initial orbit in the magnetic field (B).

Figure 3:
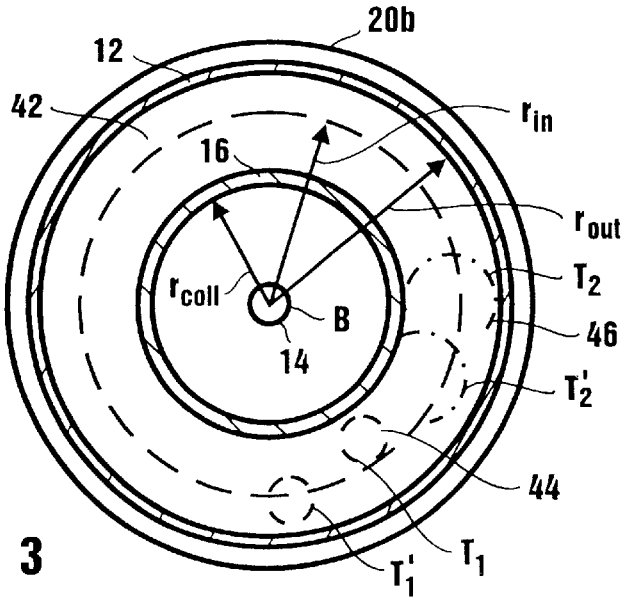
FIG. 3 is a cross sectional view of the plasma mass filter as seen along the line 3—3 in FIG. 1.

Referring now to FIG. 3, the dimensional relationships between components of the filter 10 can be best appreciated. As shown, the collector 16 is located at a radial distance $r_{coll}$ from the longitudinal axis 14. The container 12, however, is located at a radial distance $r_{out}$ from the longitudinal axis 14 such that $r_{out}$ is greater than $r_{coll}$. FIG. 3 also shows that an annular shaped region 42 is established inside the plasma chamber 18 between a radial distance $r_{in}$ and the radial distance $r_{out}$. Thus, as shown in FIG. 3, $r_{out}>r_{in}>r_{coll}$.

As indicated above, when a charged particle 38, 40 is in a magnetic field (B) it will exhibit a cyclotron movement. In the plasma chamber 18 of filter 10, however, the charged particles 38, 40 will also be influenced by the electric field (E). More specifically, with the inwardly directed electric field (E) of the filter 10, charged particles 38, 40 in the region 42 of chamber 18 will be initially urged toward the longitudinal axis 14 and the collector 16. The combined effects of the magnetic field (B) and the electric field (E) will provide the charged particle with a trajectory T. For purposes of discussion, the low mass particles 38 ($M_1$) will have a trajectory $T_1$, and the high mass particles 40 ($M_2$) will have a trajectory $T_2$. As is well known, for a given velocity, $T_2$ will be greater than $T_1$.

For the purposes of the present invention, it is important that substantially all of the charged particles 38 ($M_1$) have a cyclotron trajectory $T_1$ . which is, at most, less than the difference ($r_{in}-r_{coll}$). Further, it is also important that substantially all of the charged particles 40 ($M_2$) have a cyclotron trajectory $T_2$ which is, at least, greater than the difference ($r_{out}-r_{coll}$). The importance of these considerations will, perhaps, be best appreciated with reference to FIG. 3.

With reference to FIG. 3, consider a charged particle 38 ($M_1$) having a start point 44 at the radial distance $r_{in}$ from the longitudinal axis 14. A trajectory $T_1$, which extends less than the distance ($r_{in}-r_{coll}$) will cause the charged particle 38 ($M_1$) to avoid impact with the collector 16. It follows that substantially all other charged particles 38, which have start points that are farther from the collector 16 than the start point 44 and which have trajectories $T_1'$, will also avoid impact with the collector 16. Accordingly, the charged particles 38 of multi-species plasma 36 can be made to transit the chamber 18 from one end 30 to the other end 26 without being held by the collector 16. On the other hand, consider a charged particle 40 ($M_2$) having a start point 46 at the radial distance $r_{out}$ from the longitudinal axis 14. A trajectory $T_2$, which extends more than the distance ($r_{out}-r_{coll}$) will cause the charged particle 40 ($M_2$) to impact with the collector 16. Again it follows that substantially all of the other charged particles 40 in plasma 36, which have start points that are closer to the collector 16 than the start point 46 and which have trajectories $T_2'$, will also impact with the collector 16. Accordingly, the charged particles 40 of multi-species plasma 36 can be held by the collector 16 before they are able to transit the chamber 18 from one end 30 to the other end 26.

In the operation of the inverted orbit plasma mass filter 10 of the present invention, the multi-species plasma 36 is provided in the region 42 of the plasma chamber 18. As intended for the filter 10, the plasma 36 can either be created directly in the region 42 or it can be injected into the chamber 18 from outside the filter 10 by an injector (not shown). It happens, however, that an injection of the plasma 36 into the chamber 18 of filter 10 may have certain advantages. Specifically, due to the direction of the electric field (E), unlike a centrifuge, the charged particles in the plasma 36 will be directed inwardly toward the collector 16. Thus, a plasma 36 that is injected into the chamber 36 at or near the radial distance $r_{out}$ from the longitudinal axis 14 will benefit from the orbital mechanics of the charged particles 38, 40 discussed above.

In accordance with the mathematics developed above, an exemplary configuration for the plasma mass filter of the present invention would be a configuration for filter 10 wherein $r_{out}$=1 m, $r_{coll}$=0.65 m, with $M_1/M_2$=26/44 and $r_{in}$=0.87 m.

While the particular Inverted Orbit Filter as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. An inverted orbit plasma mass filter with an inwardly directed radial electric field which comprises:

a substantially cylindrical shaped container defining a longitudinal axis;

a substantially cylindrical shaped collector oriented along said axis to establish a plasma chamber between said container and said collector;

a magnetic means for generating a substantially uniform magnetic field (B), said magnetic field being substantially parallel to said axis in said chamber;

an electric means for generating a radially oriented electric field (E) in said chamber, said electric field being directed inwardly from said container toward said collector; and a source for providing a multi-species plasma in said chamber, said multi-species plasma including charged particles ($M_1$) of relatively low mass to charge ratio and charged particles ($M_2$) of relatively high mass to charge ratio, wherein said multi-species plasma has a low collisional density in said chamber, and wherein said multi-species plasma is provided in a region of said chamber to allow substantially all of said high mass particles ($M_2$) to move under an influence of said electric field (E) and said magnetic field (B) toward said axis and into contact with said collector, while preventing substantially all of said low mass particles ($M_1$) from moving under an influence of said electric field (E) and said magnetic field (B) into contact with said collector.

2. A plasma filter as recited in claim 1 wherein said collector is located at a distance, $r_{coll}$, from said longitudinal axis, and wherein said region in said chamber for said multi-species plasma is between a distance $r_{in}$ from said longitudinal axis and a distance $r_{out}$ from said longitudinal axis, where, $r_{coll}$ is less than $r_{in}$, and $r_{in}$ is less than $r_{out}$, ($r_{coll}<r_{in}<r_{out}$), and further where substantially all said particles $M_1$ have a cyclotron trajectory $T_1$, at most, less than the difference ($r_{in}-r_{coll}$), and substantially all said particles $M_2$ have a cyclotron trajectory $T_2$, at least, greater than the difference ($r_{out}-r_{coll}$).

3. A plasma filter as recited in claim 2 wherein said particles $M_1$ have a cyclotron frequency and said particles $M_2$ have a cyclotron frequency, and wherein said low collisional density is realized when respective ratios for cyclotron frequencies of said particles $M_1$ and $M_2$ to a collisional frequency in said multi-species plasma is greater than approximately one.

4. A plasma filter as recited in claim 3 wherein $r_{coll}$ is approximately equal to the square root of two times smaller than $r_{out}$ ($r_{coll}\approx r_{out}/\sqrt{2}$).

5. A plasma filter as recited in claim 1 wherein said container has a first end and a second end and wherein said means for generating said electric field (E) is an electrode located at said first end of said container.

6. A plasma filter as recited in claim 5 wherein said electrode comprises a plurality of substantially coaxial electrode rings.

7. A plasma filter as recited in claim 5 wherein said electrode is a spiral electrode.

8. A plasma filter as recited in claim 1 wherein said magnetic means is a plurality of magnetic coils mounted on said container around said longitudinal axis.

9. A plasma filter as recited in claim 1 further comprising:

a means for generating a vacuum in said chamber; and a means for injecting said multi-species plasma into said chamber.

10. A method as recited in claim 3 wherein $r_{coll}$ is approximately equal to the square root of two times smaller than $r_{out}$ ($r_{coll}\approx r_{out}/\sqrt{2}$).

11. A plasma filter with an inwardly directed radial electric field which comprises:

an elongated generally tubular shaped collector defining a longitudinal axis;

a means for creating a vacuum around said collector;

a magnetic means for generating an axially oriented magnetic field (B) in said vacuum;

an electric means for generating a radially oriented electric field (E) in said vacuum, said electric field being directed toward and substantially perpendicular to said collector; and a source for providing a multi-species plasma in said vacuum, said multi-species plasma including charged particles ($M_1$) of relatively low mass to charge ratio and charged particles ($M_2$) of relatively high mass to charge ratio, and wherein said multi-species plasma has a density in said chamber wherein said low mass particles ($M_1$) and said high mass particles ($M_2$) substantially avoid collisions with other said particles ($M_1$ and $M_2$) to allow said high mass particles ($M_2$) to move under an influence of said electric field (E) and said magnetic field (B) toward said axis and into contact with said collector.

12. A plasma filter as recited in claim 11 wherein said means for creating a vacuum around said collector comprises:

a substantially cylindrical shape container oriented on said longitudinal axis to establish a chamber between said container and said collector with said vacuum being created inside said chamber; and a vacuum pump connected in fluid communication with said chamber for creating said vacuum in said chamber to establish a low collisional density for said plasma wherein said particles $M_1$ have a cyclotron frequency and said particles $M_2$ have a cyclotron frequency, and wherein said low collisional density is realized when respective ratios for cyclotron frequencies of said particles $M_1$ and $M_2$ to a collisional frequency in said multi-species plasma is greater than approximately one.

13. A plasma filter as recited in claim 12 wherein said collector is located at a distance, $r_{coll}$, from said longitudinal axis, and wherein said multi-species plasma is provided in said chamber between a distance $r_{in}$ from said longitudinal axis and a distance $r_{out}$ from said longitudinal axis where, $r_{coll}$ is less than $r_{in}$, and $r_{in}$ is less than $r_{out}$, ($r_{coll}<r_{in}<r_{out}$).

14. A plasma filter as recited in claim 13 wherein said relatively low mass particles ($M_1$) have a cyclotron frequency and a cyclotron trajectory $T_1$, and said particles of relatively high mass ($M_2$) have a cyclotron frequency and a cyclotron trajectory $T_2$, with $T_2$ being greater than $T_1$ ($T_2>T_1$), and wherein $T_2$ is, at least, greater than the difference ($r_{out}-r_{coll}$) to allow said high mass particles ($M_2$) to move under an influence of said electric field (E) and said magnetic field (B) into contact with said collector, and further wherein $T_1$ is, at most, less than the difference ($r_{in}-r_{coll}$) to prevent said low mass particles ($M_1$) from moving under said influence of said electric field (E) and said magnetic field (B) into contact with said collector.

15. A plasma filter as recited in claim 14 wherein $r_{coll}$ is approximately equal to the square root of two times smaller than $r_{out}$ ($r_{coll}=r_{out}/\sqrt{2}$).

16. A plasma filter as recited in claim 14 wherein $r_{out}$=1 m, $r_{coll}$=0.65 m, with $M_1/M_2$=26/44 and $r_{in}$=0.87 m.

17. A method for filtering a multi-species plasma including charged particles ($M_1$) of relatively low mass to charge ratio and charged particles ($M_2$) of relatively high mass to charge ratio, with the multi-species plasma having a density wherein a ratio for the charged particles between their respective cyclotron frequencies and a collisional frequency in said plasma is greater than approximately one, the method comprising the steps of:

providing a substantially cylindrical shaped container defining a longitudinal axis with a substantially cylindrical shaped collector oriented along said axis to establish a plasma chamber between said container and said collector;

generating a substantially uniform magnetic field (B), said magnetic field being substantially parallel to said axis in said chamber;

generating a radially oriented electric field (E) in said chamber, said electric field being directed inwardly from said container to said collector; and providing said plasma in said chamber to allow the high mass particles ($M_2$) to move under an influence of said electric field (E) toward said axis and into contact with said collector while preventing the low mass particles ($M_1$) from moving into contact with said collector.

18. A method as recited in claim 17 further comprising the step of creating a vacuum in said chamber.

19. A method as recited in claim 17 wherein said collector is located at a distance, $r_{coll}$, from said longitudinal axis, and wherein said multi-species plasma is provided in said chamber between a distance $r_{in}$ from said longitudinal axis and a distance $r_{out}$ from said longitudinal axis where, $r_{coll}$ is less than $r_{in}$, and $r_{in}$ is less than $r_{out}$, ($r_{coll}<r_{in}<r_{out}$), and further where substantially all said particles $M_1$ have a cyclotron trajectory $T_1$, at most, less than the difference ($r_{in}-r_{coll}$), and substantially all said particles $M_2$ have a cyclotron trajectory $T_2$, at least, greater than the difference ($r_{out}-r_{coll}$).

20. A method as recited in claim 19 wherein said particles $M_1$ have a cyclotron frequency and said particles $M_2$ have a cyclotron frequency, and wherein said low collisional density is realized when respective ratios for cyclotron frequencies of said particles $M_1$ and $M_2$ to a collisional frequency in said multi-species plasma is greater than approximately one.

* * * * *

UNITED STATES PATENT AND TRADEMARK OFFICE

CERTIFICATE OF CORRECTION

PATENT NO. : 6,521,888 B1 
DATED : February 18, 2003
INVENTOR(S) : Arthur Carlson It is certified that error appears in the above-identified patent and that said Letters Patent is hereby corrected as shown below:

Column 3,
Line 35, delete [ $\frac{m_l\left(\left(\frac{r_{in}}{r_{coll}}\right)^2-1\right)}{m_h\left(\left(\frac{r_{out}}{r_{coll}}\right)^2-1\right)}=\frac{\left(\left(\frac{r_{in}}{r_{coll}}\right)^2-1\right)^2}{\left(\left(\frac{r_{out}}{r_{coll}}\right)^2-1\right)^2}$, ] insert -- $\frac{m_l\left(\left(\frac{r_{in}}{r_{coll}}\right)^2-1\right)}{m_h\left(\left(\frac{r_{out}}{r_{coll}}\right)^2-1\right)}=\frac{\left(\left(\frac{r_{in}}{r_{coll}}\right)^2-1\right)^2}{\left(\left(\frac{r_{out}}{r_{coll}}\right)^2-1\right)^2}$, --
]

Column 4,
Line 44, delete "$r_{out}$For" insert -- $r_{out}$. For --
Line 67, delete "$r_{out}$ ($r_{coll} \approx r_{out}/\sqrt{2}$)." insert -- $r_{out}$ ($r_{coll} \cong r_{out}/\sqrt{2}$). --

Column 8,
Lines 43 and 63, delete "$r_{out}$ ($r_{coll} \approx r_{out}/\sqrt{2}$)." insert -- $r_{out}$ ($r_{coll} \cong r_{out}/\sqrt{2}$). --

Column 10,
Line 5, delete "$r_{out}$ ($r_{coll} \approx r_{out}/\sqrt{2}$)." insert -- $r_{out}$ ($r_{coll} \cong r_{out}/\sqrt{2}$). --

Signed and Sealed this

Twenty-sixth Day of August, 2003

JAMES E. ROGAN
*Director of the United States Patent and Trademark Office*